United States Patent [19]

Benedek et al.

[11] 4,157,162

[45] Jun. 5, 1979

[54] ELECTROSTATIC SPRAYING APPARATUS

[76] Inventors: György Benedek, 35 Ringló utca, 1221 Budapest; András Bese, 8 Andor utca, 1119 Budapest; József Domokos, 28 Hársfa utca, 1184 Budapest; István Kovacs, 28 Garas utca, 1026 Budapest, all of Hungary

[21] Appl. No.: 846,715

[22] Filed: Oct. 31, 1977

[30] Foreign Application Priority Data

Nov. 9, 1976 [HU] Hungary ..... HA1028

[51] Int. Cl.[2] ..... B05B 5/02

[52] U.S. Cl. ..... 239/707; 361/225; 427/27

[58] Field of Search ..... 427/27; 118/627, 629; 239/3, 15, 15 R, 15 B, 15 H, 15 K, 15 W, 15 N, 15 P, 15 T, 15 V, 15 AA, 15 AB, 15 AC; 361/225–228

[56] References Cited

U.S. PATENT DOCUMENTS

| | | | |
|---|---|---|---|
| 2,314,940 | 3/1943 | Hewitt | 361/226 X |
| 2,926,106 | 2/1960 | Gauthier | 239/15 |
| 3,750,949 | 8/1973 | Luderer et al. | 239/15 |
| 3,837,573 | 9/1974 | Wagner | 239/15 |
| 3,895,262 | 7/1975 | Ribnitz | 361/227 |

FOREIGN PATENT DOCUMENTS

| | | | |
|---|---|---|---|
| 1223451 | 6/1960 | France | 239/15 |

*Primary Examiner*—Robert B. Reeves
*Assistant Examiner*—Andres Kashnikow
*Attorney, Agent, or Firm*—Poms, Smith, Lande, Glenny & Rose

[57] ABSTRACT

An electrostatic sprayer for spraying water-based paints has two or more electrodes mounted on an insulating holder and disposed in the path of the spray between the object to be coated and the outlet of the sprayer. The electrodes are at varying distances from the sprayer outlet and are connected to different potentials.

8 Claims, 4 Drawing Figures

ELECTROSTATIC SPRAYING APPARATUS

BACKGROUND OF THE INVENTION

1. Field of the Invention

The invention concerns an improved electrostatic spraying apparatus, especially (but not exclusively) for spraying water-based paints.

In this specification and claims, the word "paint" is used in a very broad sense and for convenience: it is intended to cover any material capable of being electrostatically sprayed at an object the surface of which is to be coated, for whatever purpose.

In the ever-widening application of spraying technology it would be highly desirable to be able to use water-based paints. Such paints have very important advantages over other (i.e. non-water-based) paints. Water-based paints may be diluted with ordinary pure water directly before use, in many cases simply with tap water, which means that during transporting and baking or curing of the paints no environmentally harmful vapours arise, as is the case with paints based on organic solvents. A further important advantage of water-based paints is that they are completely nonflammable.

However, the application of water-based paints in electrostatic spraying causes certain difficulties. Paints suitable for electrostatic spraying must satisfy several physical and electrical conditions. Such a condition is, for instance, the electrical resistivity of the paint: it has been shown that such paints may only be electrostatically charged satisfactorily if they possess a semi-conductor characteristic. When the resistivity of the paints is too low, the paints form a short-circuit between the usual charging electrode connected to high tension and the metallic object to be painted. This makes electrostatic paint spraying impossible. Another difficulty in the electrostatic spraying of water-based paints is that if they are not adequately charged they do not form a satisfactory conical spray.

2. Description of the Prior Art

To eliminate these disadvantages proposals have been made according to which atomization is achieved indirectly, and an insulated or earthed paint tank and/or indirect electrical charging is used. Since water-based paints cannot be atomized satisfactorily under the effect of an electrostatic force field alone, atomization has to be promoted by additional means e.g. various mechanical force effects such as centrifugal forces, pneumatic atomization or the like.

When the high-tension electrode makes direct contact with the paint, a significant amount of electrostatic charge can leak to the earthed paint tank via the usual long and narrow paint supply conduit. Where the paint supply conduit is too lengthy and of a narrow cross-section the amount of paint throughflow is insufficient. The high-tension generators conventionally used in the painting industry cannot even at maximum load, generate sufficient current to flow in the direction of the tank, as a result of the low resistance of the paint. Thus short-circuits occur and the potential falls to zero.

Although it is possible to place the tank on insulated or earthed legs in order to prevent the charge that has leaked into the tank from going to earth, nevertheless even here the tank has a significant potential relative to earth, and consequently so does the spraying apparatus, which circumstance carries the risk of shocks for an operator. At the same time one must ensure that the charge accumulated in the tank should be able to leak or flow away after switching the apparatus on. This can be solved by providing an earthing apparatus or a line connected to the tank.

SUMMARY OF THE PRESENT INVENTION

An aim of this invention is to provide apparatus for electrostatic spray painting capable of spraying, inter alia, water-based paints with an improved efficiency. The invention is based on the discovery that the efficiency of electrostatic paint spraying can be improved if the electrode tips are disposed at various distances ahead (i.e. downstream of, in relation to the travel of the paint from the spraying apparatus to the object or workpiece to be painted) the spraying apparatus, in the direction of spraying, and are connected to different potentials.

Accordingly, the invention provides an improved electrostatic paint spraying apparatus, particularly but not exclusively for water-based paints, comprising a spraying device including means for atomizing and spraying the paint, electrode means arranged in an insulating holder and disposed downstream of the spraying apparatus relative to the discharge direction of the paint spray, high tension connections for connecting the electrode means to a source of high tension, wherein said electrode means comprises at least two electrodes disposed at differing distances from the spraying device along the direction towards the object to be coated and the consecutive electrodes are connected by means of the high tension connections to different potentials.

As our experiments have verified, embodiments of the apparatus according to the invention are capable of providing 30 to 60% increase in the charge imparted to the paint, compared with known apparatus.

According to a preferred embodiment of the invention the potential of the (tip) electrodes increases stepwise in proportion with the increase in distance of the electrodes from the spraying apparatus. The successive electrode tips are expediently terminated in the region of the axis of symmetry of spray. One method of providing different potentials is to connect the high tension connection of each electrode to a common high tension source with the intermediation of resistors of different resistance values, expediently via a common line. The resistors may be connected serially in a common line and high tension connectors are then expediently connected to a common line between them.

In another embodiment, the electrodes with the high tension connectors and holders may constitute a structural unit independent of the spraying apparatus. This unit may be mounted on the spraying apparatus or it may be positioned independently thereof.

BRIEF DESCRIPTION OF THE DRAWINGS

The invention is described in detail, merely by way of example, with reference to the preferred embodiments shown on the accompanying schematic drawings, wherein.

DESCRIPTION OF THE PREFERRED EMBODIMENTS

Figure 1:
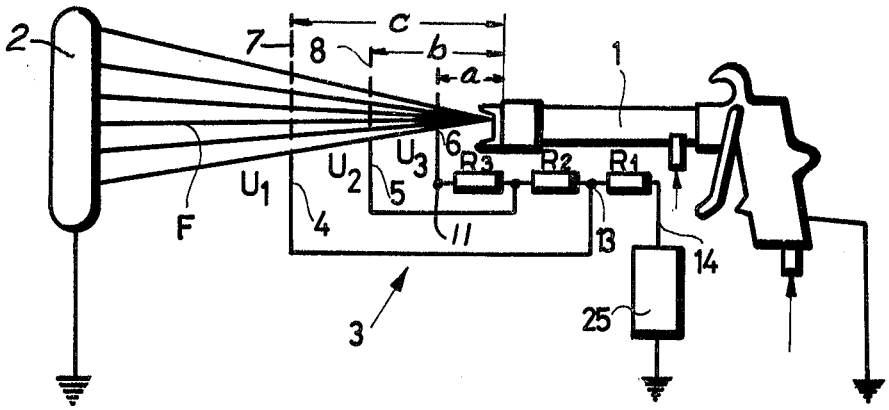
FIG. 1 shows an apparatus according to the invention in the form of a spraying gun or pistol.

Referring first to FIG. 1 there is shown a spraying apparatus in the form of a pistol 1 although any other spraying device may be used. The illustrated spraying pistol 1 operates with pneumatic atomization indicated schematically by an inlet for compressed air on the "butt" of the piston and an arrow, but naturally other methods of atomization may be employed. A paint inlet with an arrow are also shown schematically at the rear end of the "barrel".

In use, water-based paint is sprayed from the pistol 1 in a spraying direction F towards an object 2 to be coated. The outside of the pistol 1 and the object 2 are both connected to earth potential. Positioned between the pistol 1 and the object 2 is an electrode system designated as a whole by the reference number 3 and comprising two to six edge, needle or tip electrodes mounted on an insulating holder not shown in the schematic FIG. 1 but shown in the other Figures. In the illustrated embodiment, there are three electrodes 4, 5 and 6. The electrodes 4, 5 and 6 are disposed at varying distances from the pistol 1 along the direction F, and are connected to a high tension D.C. supply 25 which may for example be a generator and the other pole of which is earthed.

As shown in FIG. 1, the three electrodes 4, 5 and 6 are disposed in parallel vertical planes 7, 8 and 9 which are at different distances a, b and c from the discharge end of the pistol 1.

The electrode 6 nearest to the spraying apparatus is a distance which is at least sufficient to ensure that no back conduction or leakage should take place towards the earthed spraying apparatus along the spray itself. This is necessary to ensure that e.g. water-based paints or other electrically conductive paints should be sprayable.

The electrodes 4, 5 and 6 are connected by way of respective connections or terminals 13, 12 and 11 to a high tension lead or conductor 14. As shown in FIG. 1, the electrodes 4, 5 and 6 are at an increasing potential $U_1$, $U_2$ and $U_3$ as their distance from the spray gun increases, i.e. $U_1 > U_2 > U_3$. Thus the electrode 6 nearest to the spraying apparatus is at the lowest potential while the farthest electrode 4 is at the highest potential. This may be most simply achieved, as seen in FIG. 1, by connecting the common conductor 14 to the high tension source 25 and serially connecting into this conductor 14 choke resistors $R_1$, $R_2$ and $R_3$. The high tension connectors 11, 12 and 13 are connected between these resistors to the line 14. In this way the current flowing through the resistors decreases as desired with the voltage. This current is made up of the charges flowing out of the tips of the electrodes and the ion current. Thus the electrodes are connected to gradually decreasing potentials which are adequate to the load that may in use be applied to them.

As is well-known, electrode tips or needle electrodes have a double function. On the one hand, they provide an electrostatic force field between themselves and the object 2 to be coated; on the other hand, they ionize the air in the vicinity of the spray and in this way the spray particles or droplets are given a charge which assists them in flying in the direction of the object 2. As they get further away from the spraying device, the spray particles are gradually accelerated because of the increase in potential that they experience. Although in this embodiment there is an electrostatic force field between the electrodes and the earthed spraying device, nevertheless the particles are adequately accelerated since once they are past the electrode 6 nearest the spraying apparatus they come under and are accelerated by the effect of the force field directed towards the object 2 to be coated. The advantage of this arrangement is that the electrode nearest the spraying apparatus 1 has the smallest potential and thus the force field from this electrode 6 towards the spraying apparatus 1 is not particularly large. Thus the electrode 6 nearest to the spraying apparatus 1 serves mainly for the rapid ionization of the surrounding air. The other electrodes also help in the further ionization of the air but mainly they serve for the establishment of an electrostatic force field directed towards the object 2 to be coated.

The potential applied to the electrodes and the potential differences may be selected as required for the force fields desired. In place of a single electrode in each of the planes 7, 8 and 9 several electrodes may be positioned amongst which those which are coplanar have the same potential. As an example, an electrode frame may be mounted on a support of insulating material to surround the spray from at least two opposite sides with electrode tips or edges projecting from the electrode frame. These can be distributed along the full width of the spray so as to produce a uniform ion wind. In given cases in the different planes 7, 8, 9 one may position an electrode grid, mesh or lattice crossing or intersecting the spray and having tips or edges projecting towards the object 2, in which case the particles coming into contact with the grid are charged directly.

Figure 2:
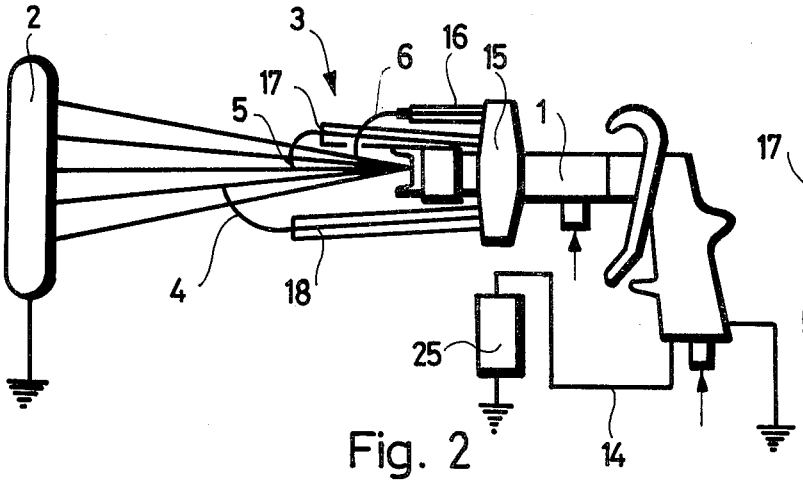
FIG. 2 shows the use of an electrode arrangement having three tip electrodes associated with a spraying pistol.
Figure 3:
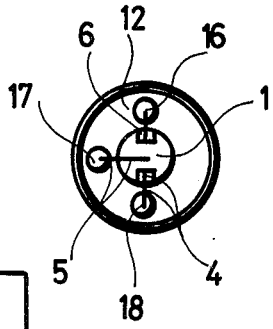
FIG. 3 is a front elevational view of the electrode arrangement shown in FIG. 2.

The schematic arrangement of the electrodes in FIG. 1 can be embodied practically as shown in FIGS. 2 and 3. In these Figures a holder frame 15 is disposed on the spraying device 1 and is made of an insulating material. Tubes of insulating material 16, 17 and 18 are arranged on the frame 15 for the electrodes and from the free end of the tubes the electrode tips 4, 5 and 6 are extended into the spray. As can be seen from FIG. 3, the insulating tubes 16, 17, and 18 are disposed at a mutual angular offset of 90°.

When the choke resistors $R_1$, $R_2$ and $R_3$ are used in a serial arrangement as shown in FIG. 1 then the resistors may be mounted in or on the frame 15. When, however, the resistors of differing resistances are connected in parallel, then they may be disposed in the insulating tubes 16, 17, 18 themselves.

Although in the embodiments of FIGS. 2 and 3 a conductor 14 connects the high tension source 25 to the spraying pistol 1, in another, non-illustrated embodiment the conductor 14 may be connected directly to the frame 15 which is releasably connected to the outlet portion of the spraying apparatus 1.

Figure 4:
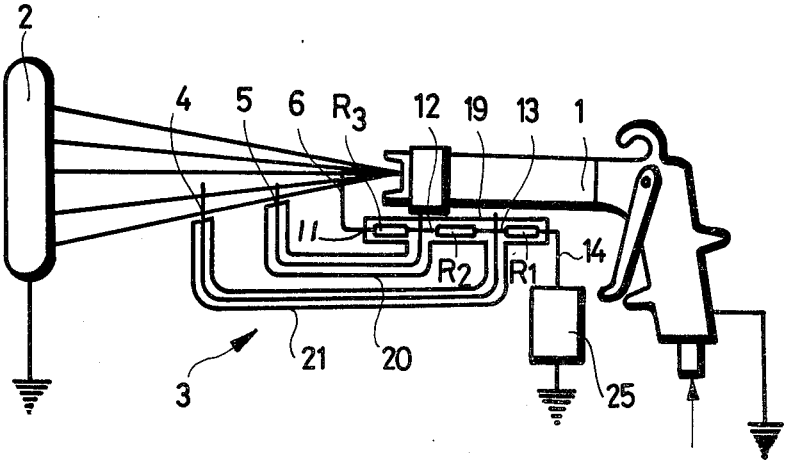
FIG. 4 is a further embodiment of apparatus according to the invention.

The schematically illustrated embodiment in FIG. 4 shows serially connected choke resistors $R_1$, $R_2$ and $R_3$ arranged in accordance with the scheme of FIG. 1 and disposed in an insulating tube 19. The rear of this insulating tube is connected with a high tension source 25 via a conductor 14. Further insulating tubes 20 and 21 are branched off from the insulating tube 19 through which the junctions between the individual resistors are connected to the electrodes. The length of the insulating tubes 19, 20 and 21 are selected in accordance with the distances required for the electrodes 4, 5 and 6.

In the embodiment of FIG. 4, the assembly of electrode tips is a separate unit but in fact it may be connected, preferably releasably, to the spraying apparatus 1.

We claim:

1. An electrostatic spraying apparatus suitable for spraying a grounded workpiece with a water-based paint, comprising a grounded spraying device including a spraying outlet, means associated with said device for atomizing the paint, an insulating holder disposed about said device, ionizing needle electrode means arranged in said insulating holder and disposed externally of the spraying device and downstream of the spraying outlet relative to the direction of travel of the paint spray, high tension connections for connecting the electrode means to a source of high tension, wherein the improvement consists in that said electrode means comprises at least three electrodes disposed at differing distances from the spraying device along the direction of travel of the water-based paint spray towards the grounded workpiece to be coated and the consecutive electrodes are in use connected by means of the high tension connections to potentials that increase with their respective distance from the spraying outlet.

2. Apparatus according to claim 1 wherein in use the potential applied to the electrodes increases proportionally and stepwise with the distance of the electrodes from the spraying device.

3. Apparatus according to claim 1 wherein the electrodes are in the form of needles terminating in the path of the spray.

4. Apparatus according to claim 1 wherein the electrodes, the high tension connections and the said holder constitute a structural assembly independent of the spraying device.

5. Apparatus according to claim 1 wherein the electrodes, the high tension connections and the said holder constitute a structural assembly readily releasably attached to the spraying device.

6. Apparatus according to claim 1 wherein tubes of insulating material correspond in number to the number of electrodes are connected to the holder, and each electrode is in part accommodated in a respective tube.

7. Apparatus according to claim 1 wherein three serially connected resistors are connected to the high tension source, the electrode farthest from said outlet being connected to the junction between the central resistor and the resistor nearest to said source, the central electrode being connected to the junction between the central resistor and the resistor farthest from said source, and the electrode nearest to said outlet being conducted to the resistor farthest from said source.

8. Apparatus according to claim 7 wherein each resistor is accommodated in a tube of insulating material.

* * * * *